US011501906B2

(12) United States Patent
Chen

(10) Patent No.: US 11,501,906 B2
(45) Date of Patent: Nov. 15, 2022

(54) INDUCTOR MANUFACTURING METHOD

(71) Applicant: Chilisin Electronics Corp., Hsinchu (TW)

(72) Inventor: Chia Chen Chen, Taipei (TW)

(73) Assignee: CHILISIN ELECTRONICS CORP., Hsinchu (TW)

( * ) Notice: Subject to any disclaimer, the term of this patent is extended or adjusted under 35 U.S.C. 154(b) by 846 days.

(21) Appl. No.: 16/420,226

(22) Filed: May 23, 2019

(65) Prior Publication Data

US 2020/0373057 A1 Nov. 26, 2020

(51) Int. Cl.

| | |
|---|---|
| ***H01F 7/06*** | (2006.01) |
| ***H01F 27/06*** | (2006.01) |
| ***H01F 41/06*** | (2016.01) |
| ***C25D 7/00*** | (2006.01) |
| ***C25D 5/10*** | (2006.01) |
| ***H01F 41/02*** | (2006.01) |
| ***H01F 41/04*** | (2006.01) |

(52) U.S. Cl.

CPC ..... *H01F 27/06* (2013.01); *C25D 5/10* (2013.01); *C25D 7/00* (2013.01); *H01F 41/024* (2013.01); *H01F 41/042* (2013.01); *H01F 41/06* (2013.01); *Y10T 29/4902* (2015.01)

(58) Field of Classification Search

CPC ..... H01L 2924/30107; H01F 6/06; H01F 41/0246; H01F 27/2852; H01F 3/08; H01F 41/06; Y10T 29/4902; Y10T 29/49126

USPC ..... 29/602.1, 419.2, 603.08, 604, 605, 795

See application file for complete search history.

(56) References Cited

U.S. PATENT DOCUMENTS

| | | | | |
|---|---|---|---|---|
| 7,362,201 | B2 * | 4/2008 | Saegusa | H01F 41/005 336/92 |
| 9,236,180 | B2 | 1/2016 | Kim et al. | |
| 9,449,917 | B2 | 9/2016 | Luo et al. | |
| 9,520,223 | B2 | 12/2016 | Yoo et al. | |
| 9,704,943 | B2 | 7/2017 | Lai et al. | |
| 9,859,054 | B2 | 1/2018 | Yamamo | |
| 9,892,852 | B2 | 2/2018 | Itoh et al. | |
| 10,242,796 | B2 | 3/2019 | Kitamura | |
| 11,289,262 | B2 * | 3/2022 | Kawarai | H01F 27/24 |

* cited by examiner

*Primary Examiner* — Thiem D Phan

(74) *Attorney, Agent, or Firm* — Li & Cai Intellectual Property Office

(57) ABSTRACT

An inductor manufacturing method includes making a coil with a wire member, the coil has two end portions, bending a dependent segment from one end portion of the coil, and bending a lateral extension from the dependent segment, bending a bent segment from the second end portion of the coil, and bending a lateral segment from the bent segment, a base member is then engaged into a space between the coil and the lateral extension and the lateral segment of the coil for forming a coil assembly, the coil assembly is then engaged into a mold cavity of a mold device and punched together with an iron powder, the lateral extension and the lateral segment of the coil are electroplated with an electroplating layer.

7 Claims, 10 Drawing Sheets

INDUCTOR MANUFACTURING METHOD

BACKGROUND OF THE INVENTION

1. Field of the Invention

The present invention relates to an inductor manufacturing or making method, and more particularly to an inductor manufacturing method including an improved and simplified making or manufacturing procedure for suitably reducing or decreasing the occupied volume of the inductors and for allowing the inductors to be easily and quickly and effectively made or manufactured, and for allowing the inductors to be easily and quickly connected or coupled to the printed circuit boards or the like.

2. Description of the Prior Art

Various kinds of typical inductor manufacturing methods have been developed and provided for making or manufacturing inductors or the like with such as surface mount technologies or procedures or the like, and comprise an inductor product for suitably connecting or coupling to the printed circuit boards or the like.

For example, U.S. Pat. No. 9,236,180 B2 to Kim et al., U.S. Pat. No. 9,449,917 B2 to Luo et al., U.S. Pat. No. 9,520,223 B2 to Yoo et al., U.S. Pat. No. 9,704,943 B2 to Lai et al., U.S. Pat. No. 9,859,054 B2 to Yamamo, U.S. Pat. No. 9,892,852 B2 to Itoh et al., and U.S. Pat. No. 10,242,796 B2 to Kitamura disclose several of the typical methods for making or manufacturing inductors or the like.

However, the manufactured inductors normally include a great volume that may not be easily and quickly made or manufactured, and that may not be easily and quickly connected or coupled to the printed circuit boards or the like.

The present invention has arisen to mitigate and/or obviate the afore-described disadvantages of the conventional inductor manufacturing methods.

SUMMARY OF THE INVENTION

The primary objective of the present invention is to provide an inductor manufacturing method including an improved and simplified making or manufacturing procedure for suitably reducing or decreasing the occupied volume of the inductors and for allowing the inductors to be easily and quickly and effectively made or manufactured, and for allowing the inductors to be easily and quickly connected or coupled to the printed circuit boards or the like.

In accordance with one aspect of the invention, there is provided an inductor manufacturing method comprising making a coil with a wire member, the coil including a first end portion and a second end portion, bending a dependent segment from the first end portion of the coil, and bending a lateral extension from the dependent segment, bending a bent segment from the second end portion of the coil, and bending a lateral segment from the bent segment, forming a space between the coil and the lateral extension and the lateral segment of the coil, engaging a base member into the space between the coil and the lateral extension and the lateral segment of the coil, for forming a coil assembly, engaging the coil assembly into a mold cavity of a mold device, filling an iron powder into the mold cavity of the mold device, punching the coil assembly and the iron powder to form a prototype, disengaging the prototype from the mold cavity of the mold device, annealing the prototype, lasering the lateral extension and the lateral segment of the coil, and electroplating an electroplating layer to the lateral extension and the lateral segment of the coil, for allowing the inductor to be easily and quickly and effectively made or manufactured, and for allowing the inductor to be easily and quickly connected or coupled to the printed circuit boards or the like.

The electroplating layer includes a copper layer, and/or a nickel layer, and/or a tin layer. The iron powder is selected from an outer diameter ranged from 0.1 to 200 micron.

The coil assembly and the iron powder are subjected with a punching force ranged from 0.1-10 ton. The prototype is subjected with an annealing temperature ranged between 300-600° C. for one hour.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
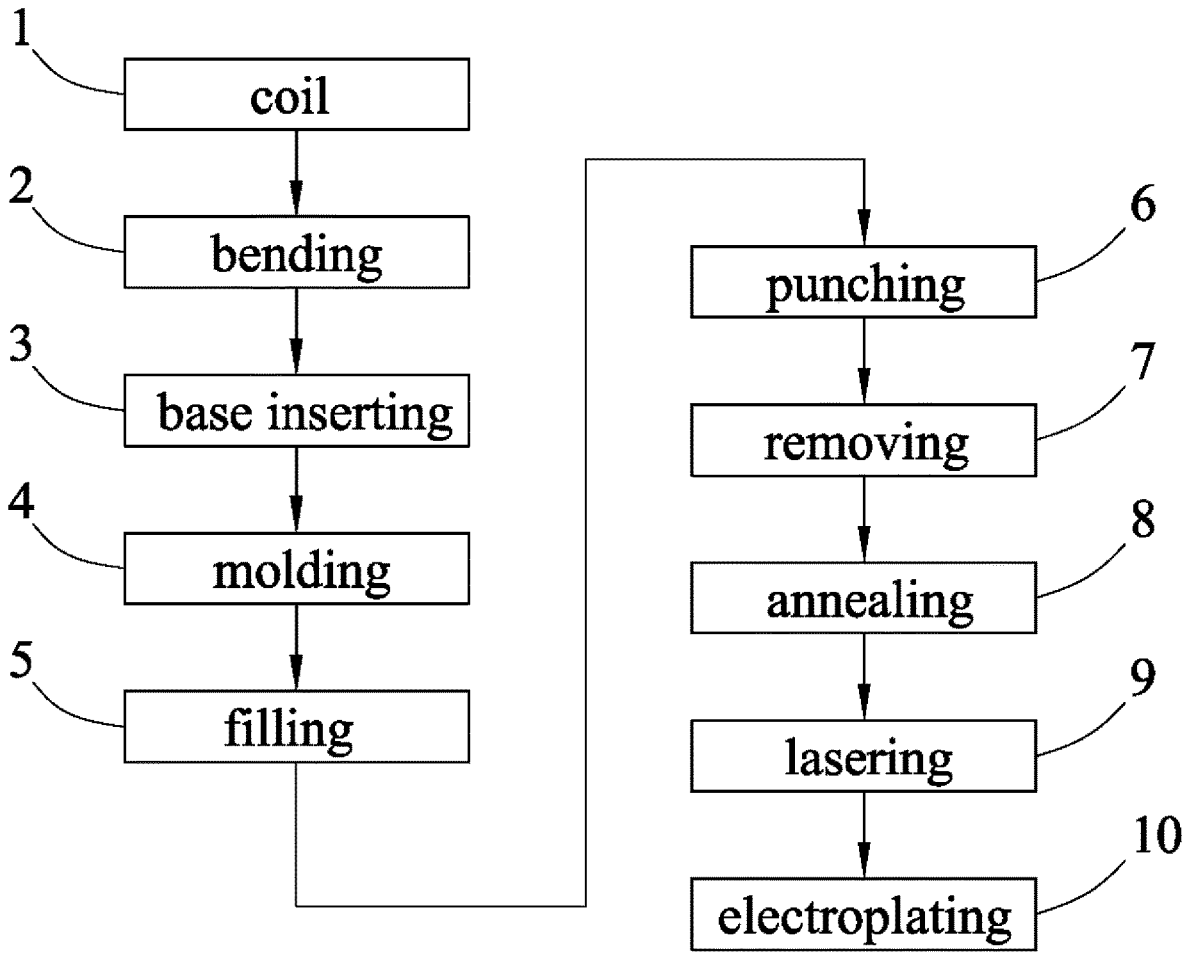
FIG. 1 is a block diagram illustrating the making or manufacturing procedures or processes or steps for making the inductors.
Figure 2:
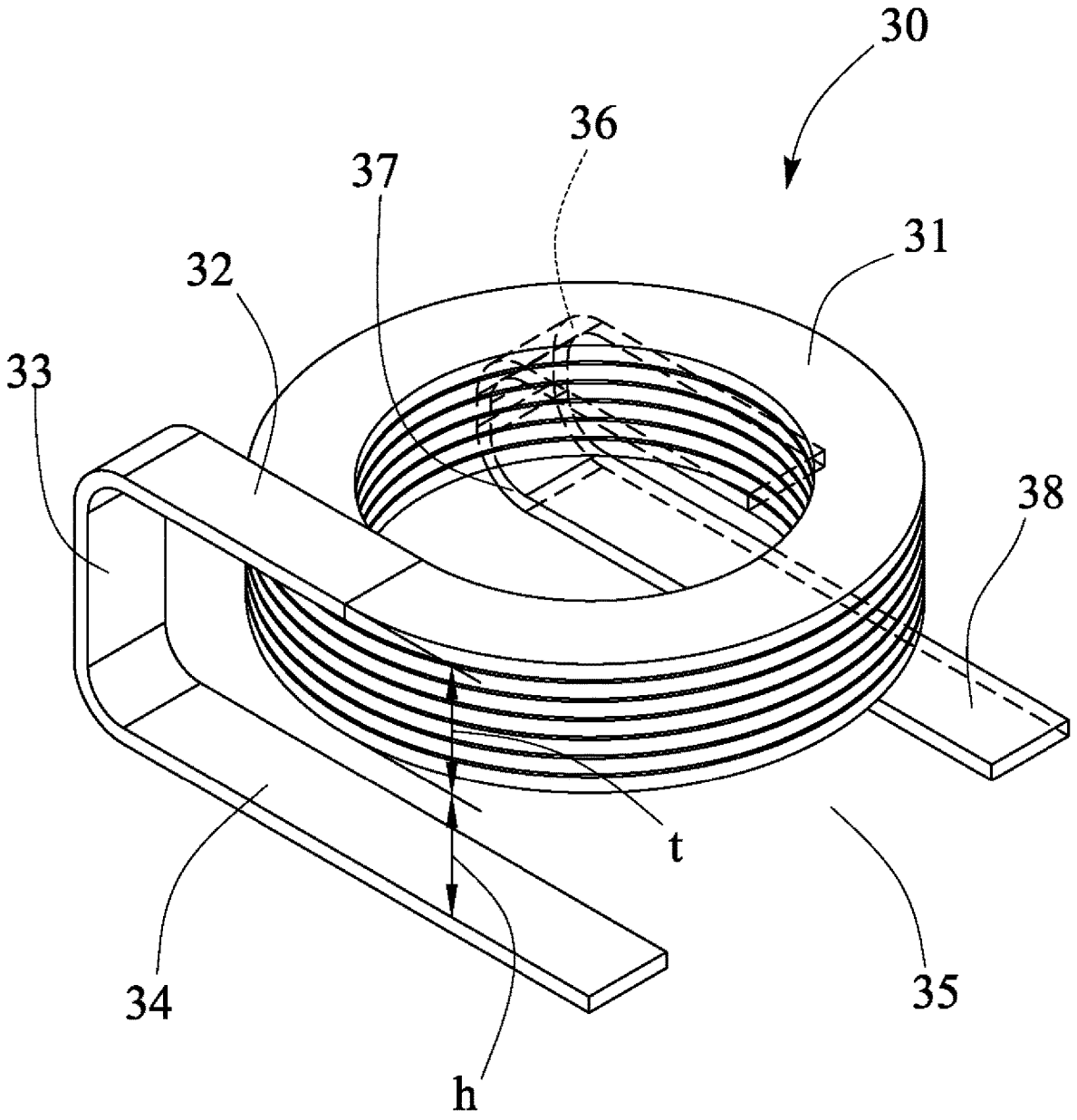
FIG. 2 is a perspective view illustrating a coil to be made or manufactured with the inductor manufacturing method.
Figure 3:
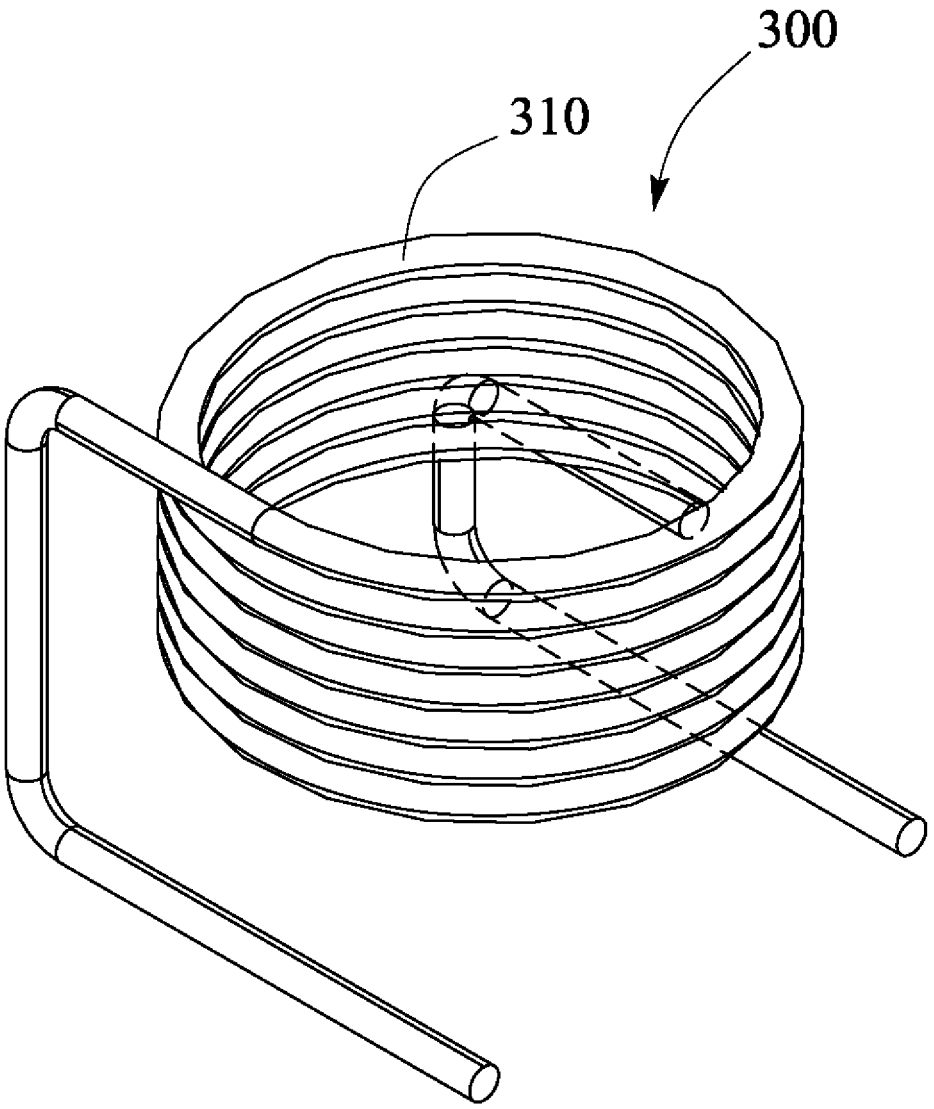
FIG. 3 is another perspective view similar to FIG. 2, illustrating the other arrangement of the coil to be made or manufactured with the inductor manufacturing method.
Figure 4:
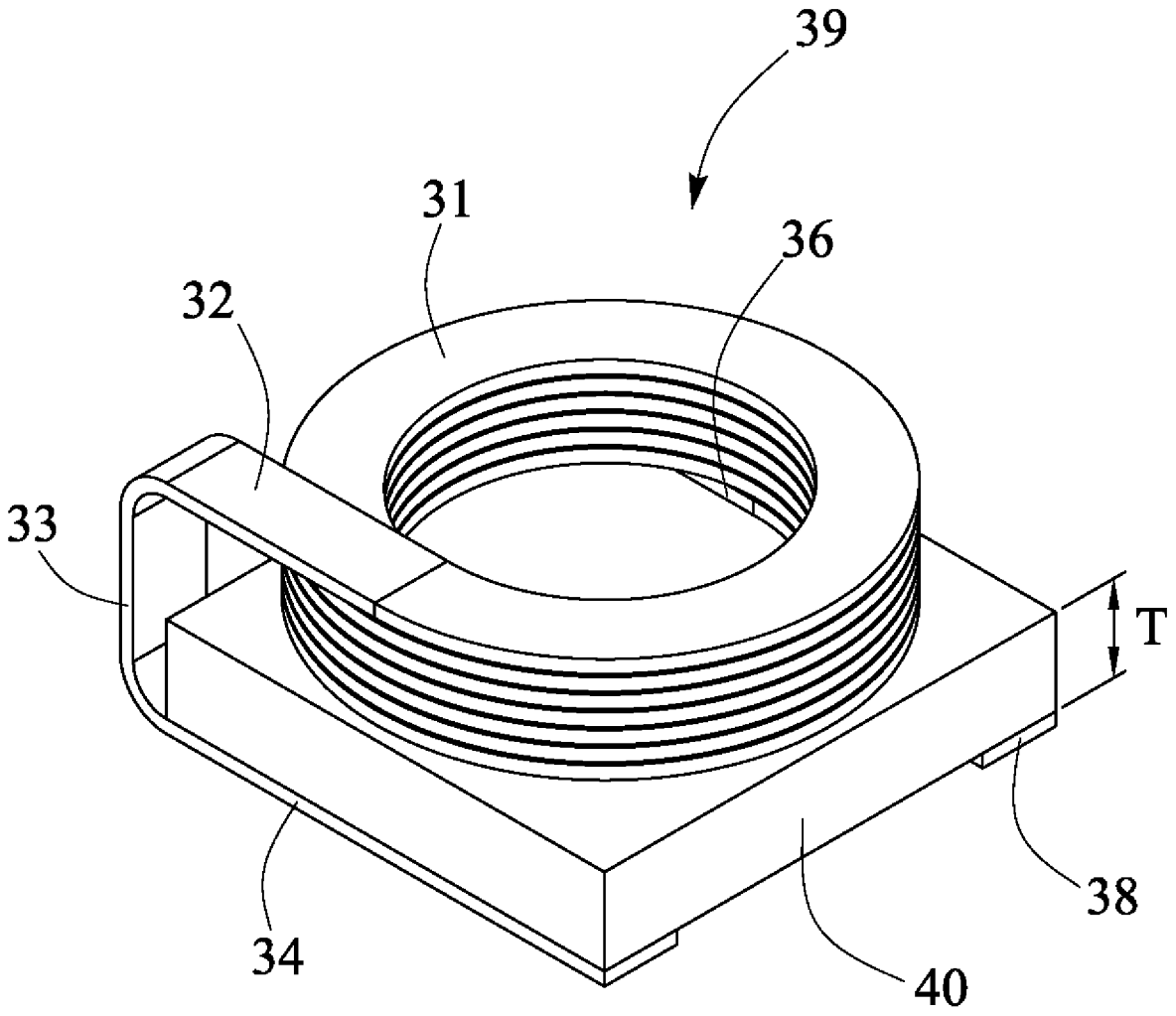
FIG. 4 is a further perspective view similar to FIGS. 2 and 3, illustrating the coil assembly to be made or manufactured with the inductor manufacturing method.

Referring to the drawings, and initially to FIGS. 1 and 2, an inductor manufacturing method in accordance with the present invention comprises a coiling procedure or process 1 for making or manufacturing a coil 30 which may be made or formed with an elongated or longitudinal wire member 31 that includes a square or rectangular cross section (FIGS. 2, 4), or alternatively, as shown in FIG. 3, the coil 300 may be made or formed with an elongated or longitudinal wire member 310 that includes a circular cross section.

The wire member 31 or the coil 30 includes one or upper or first end portion 32 having a dependent segment 33 extended downwardly therefrom with a bending process 2 (FIG. 1), and preferable, but not necessary that the dependent segment 33 is perpendicular to the first end portion 32 of the coil 30, and a lateral extension 34 extended from the dependent segment 33 and perpendicular to the dependent segment 33 and parallel to the first end portion 32 of the coil 30, and extended and located below the first end portion 32 of the coil 30.

Figure 5:
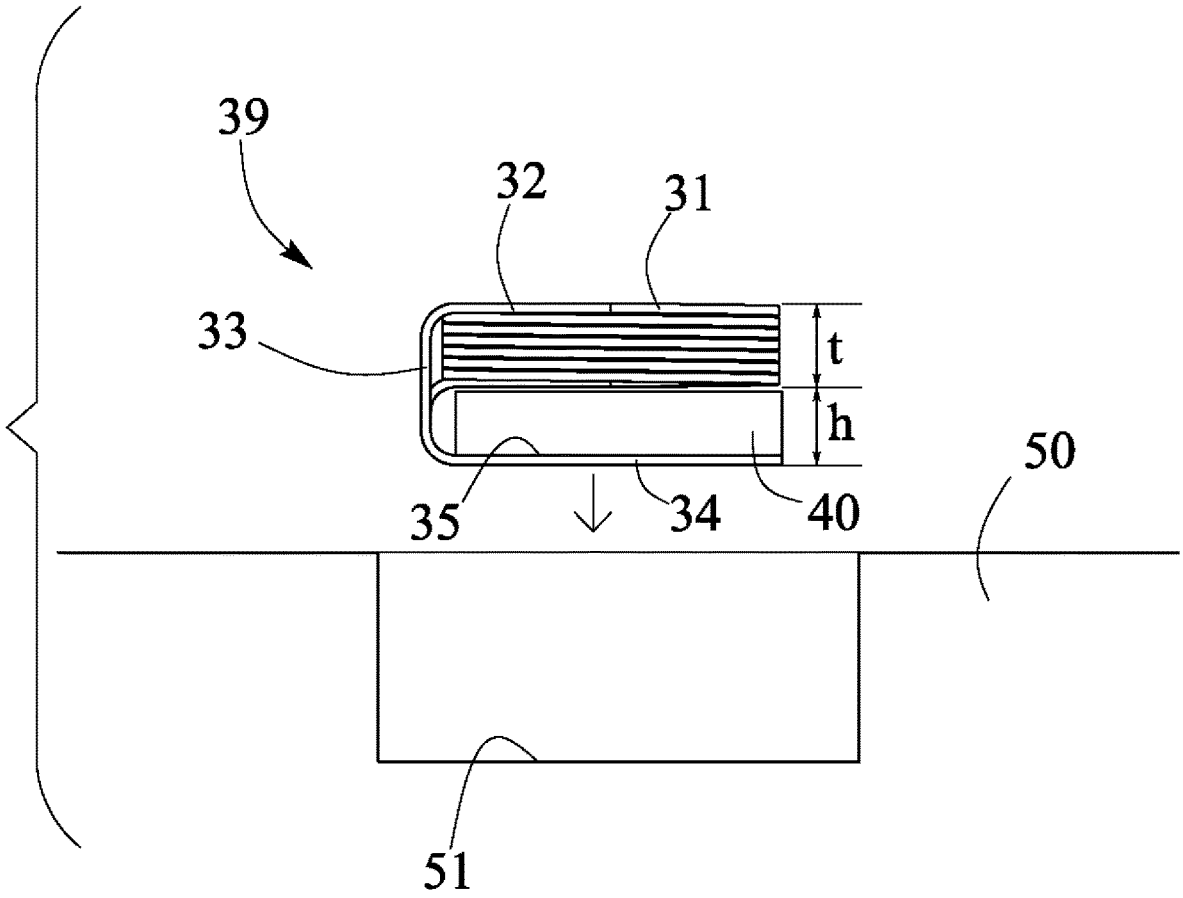
FIG. 5 is a plan schematic view illustrating a molding procedure or process for making the inductor.

As shown in FIGS. 2 and 5, it is preferable that the length of the dependent segment 33 of the coil 30 equals to the thickness "t" of the coil 30 and the height "h" of the space 35 that is formed or defined between the coil 30 and the lateral extension 34 of the coil 30 and that is formed or provided for receiving or engaging with a base member 40 (FIG. 4) in a base inserting or introducing process 3, and for forming a coil assembly 39 that includes the coil 30 and the base member 40, in which the base member 40 is preferably made of magnetic materials, and the thickness "T" of the base member 40 (FIG. 4) is preferably equal to or no greater than the height "h" of the space 35 that is formed or defined between the coil 30 and the lateral extension 34 of the coil 30.

The wire member 31 or the coil 30 further includes another or lower or second end portion 36 having a bent segment 37 extended downwardly therefrom with the bending process 2, and preferable, but not necessary that the bent segment 37 is perpendicular to the second end portion 36 of the coil 30, and a lateral segment 38 extended from the bent segment 37 and perpendicular to the bent segment 37 and parallel to the second end portion 36 of the coil 30, and extended and located below the second end portion 36 of the coil 30, the length of the bent segment 37 is preferably equal to or no less than the height "h" of the space 35 that is formed or defined between the coil 30 and the lateral extension 34 of the coil 30 for allowing the base member 40 to be received or engaged in the space 35 that is formed or defined between the coil 30 and the lateral extension 34 and the lateral segment 38 of the coil 30.

Figure 6:
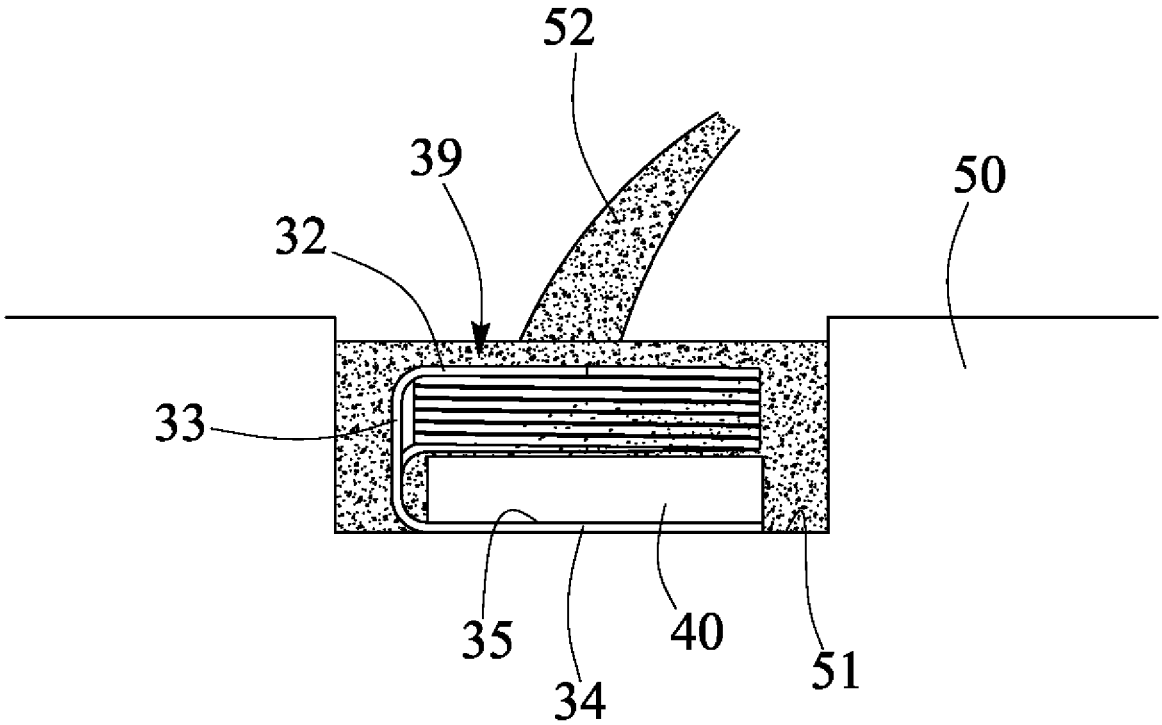
FIG. 6 is a partial cross sectional view illustrating an iron powder filling procedure or process for making the inductor.

As shown in FIG. 5, the coil assembly 39 that includes the coil 30 and the base member 40 is then disposed or engaged into a mold cavity 51 of a mold device 50 in a molding process 4 (FIG. 1), and as shown in FIG. 6, a metallic or iron particle or powder 52 is then filled or introduced into the mold cavity 51 of the mold device 50 in an iron powder introducing or filling process 5. It is preferable, but not necessary that the particles of the iron powder 52 include or are selected from an outer diameter ranged from 0.1 to 200 micron.

Figure 7:
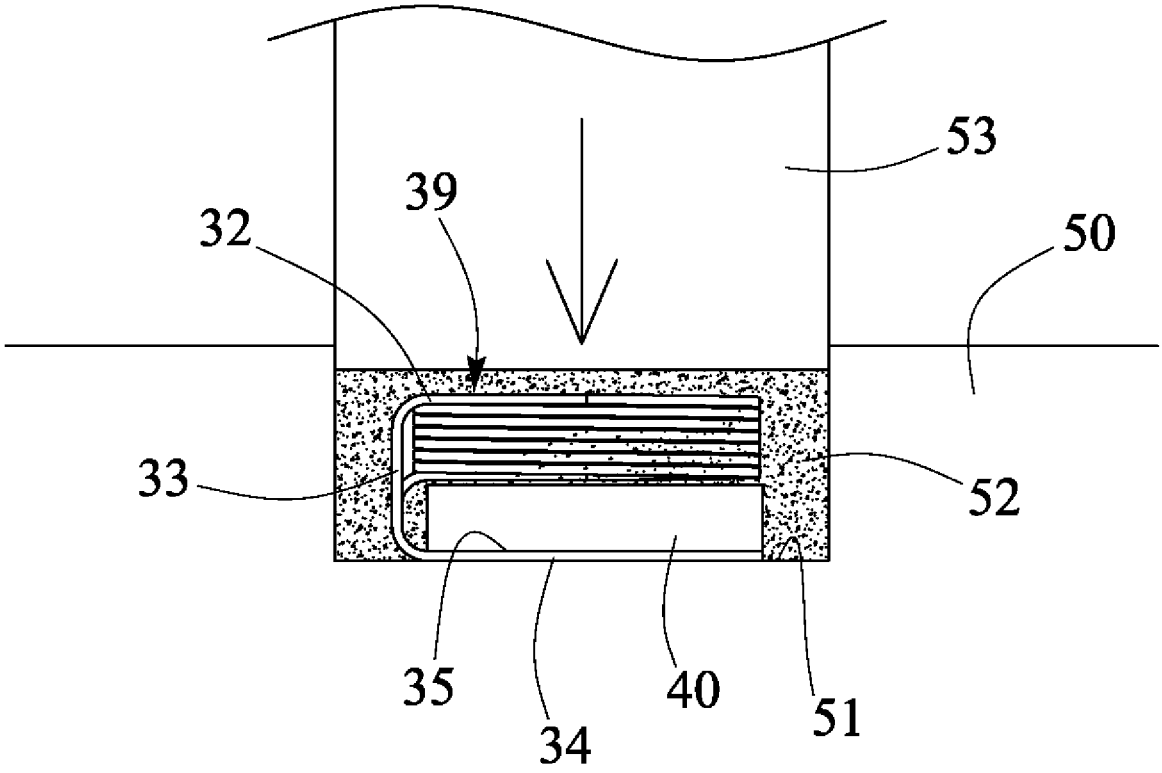
FIG. 7 is another partial cross sectional view similar to FIG. 6, illustrating a punching or pressing procedure or process for making the inductor.
Figure 8:
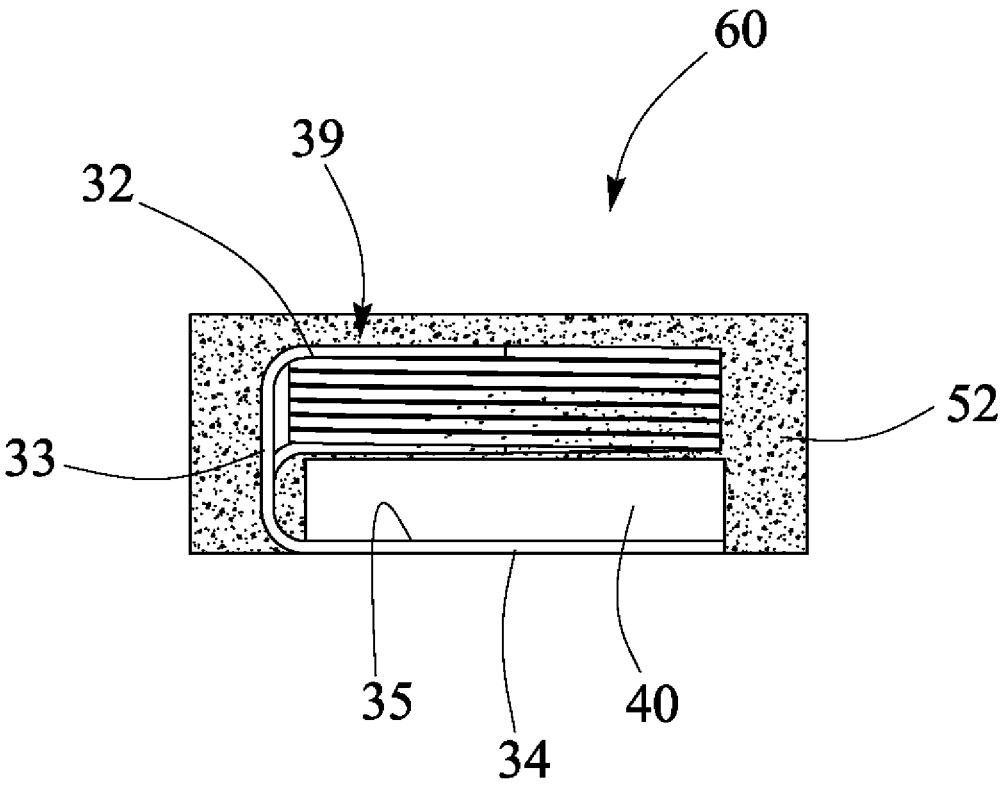
FIG. 8 is a further partial cross sectional view similar to FIGS. 6 and 7, illustrating a prototype to be made or manufactured with the inductor manufacturing method.

As shown in FIG. 7, the coil assembly 39 and the iron powder 52 are then subjected or dealt with a hammering or punching device 53 in a depressing or punching process 6 (FIG. 1), and in order to form the prototype 60 (FIG. 8) that includes the coil assembly 39 and the iron powder 52 solidly and stably mounted or secured together to form a one-integral piece, and that is removed and disengaged from the mold cavity 51 of the mold device 50 in a removing or disengaging process 7 (FIG. 1), and the punching device 53 may apply a punching force of about 0.1-10 ton to the coil assembly 39 and the iron powder 52.

Figure 9:
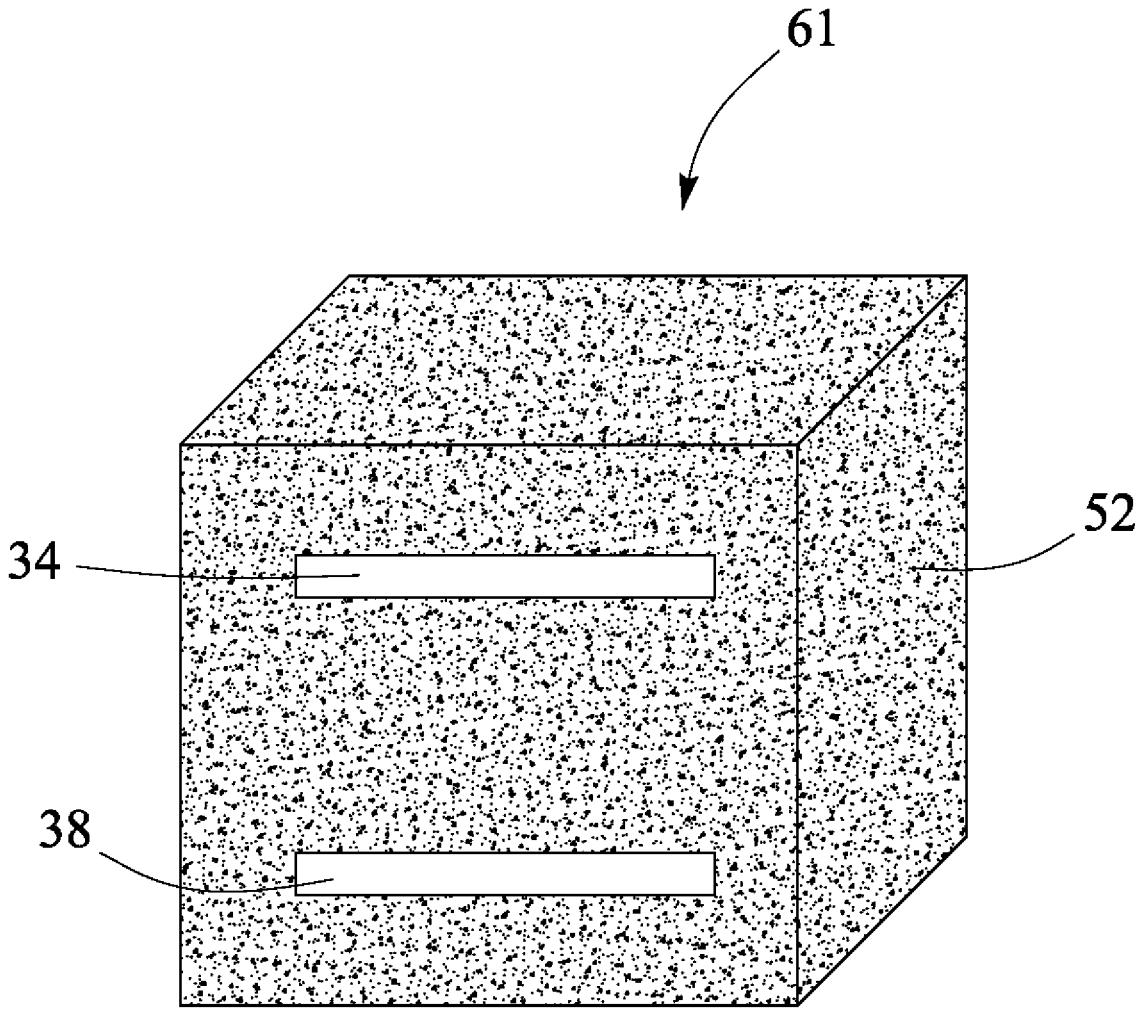
FIG. 9 is a perspective view illustrating an inductor to be made or manufactured with the inductor manufacturing method.

The prototype 60 is then subjected or dealt with an annealing procedure or process 8 (FIG. 1) in order to form the final product of the inductor 61 (FIG. 9), the annealing process 8 is preferably maintained in a temperature ranged between 300-600° C. for about one hour or the like. The inductor 61 may further be subjected or dealt with a laser procedure or process 9 (FIG. 1) for removing or separating a lacquer film from the lateral extension 34 and the lateral segment 38 of the coil 30 and for forming an electrode or conductive surface for the lateral extension 34 and the lateral segment 38 of the coil 30.

Figure 10:
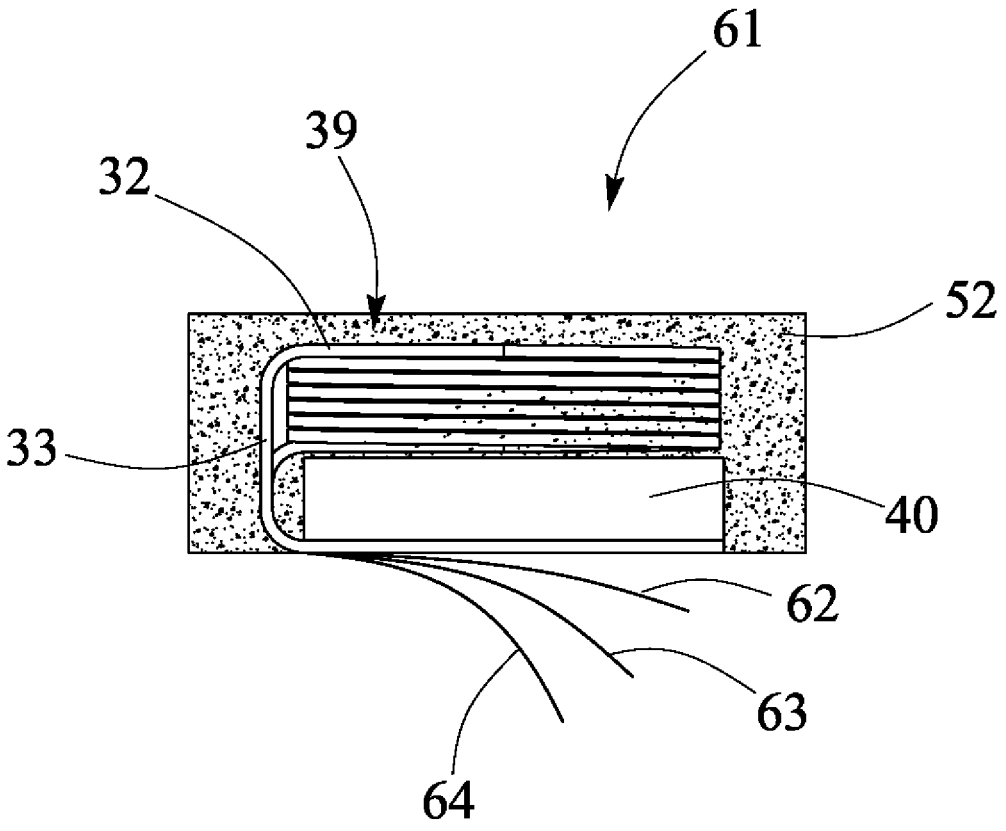
FIG. 10 is a still further partial cross sectional view similar to FIG. 8, illustrating the inductor to be made or manufactured with the inductor manufacturing method.

As shown in FIG. 10, the inductor 61 may further be subjected or dealt with an electroplating procedure or process 10 (FIG. 1) for electroplating an electroplating layer, such as a copper layer 62 and/or a nickel layer 63 and/or a tin layer 64 onto the lateral extension 34 and the lateral segment 38 of the coil 30, and for allowing the inductor 61 to be easily and quickly and effectively attached or mounted or secured or connected or coupled to the printed circuit boards or the like with such as the surface mount technologies or procedures or the like.

The inductor 61 may include a greatly reduced or decreased volume or size or standard, and the lateral extension 34 and the lateral segment 38 of the coil 30 may include a greatly increased area for effectively attaching or mounting or securing or coupling to the printed circuit boards or the like.

Accordingly, the inductor manufacturing method in accordance with the present invention includes an improved and simplified making or manufacturing procedure for suitably reducing or decreasing the occupied volume of the inductors and for allowing the inductors to be easily and quickly and effectively made or manufactured, and for allowing the inductors to be easily and quickly connected or coupled to the printed circuit boards or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An inductor manufacturing method comprising:

making a coil with a wire member, said coil including a first end portion and a second end portion, bending a dependent segment from said first end portion of said coil, and bending a lateral extension from said dependent segment, bending a bent segment from said second end portion of said coil, and bending a lateral segment from said bent segment, forming a space between said coil and said lateral extension and said lateral segment of said coil, engaging a base member into said space between said coil and said lateral extension and said lateral segment of said coil, for forming a coil assembly, engaging said coil assembly into a mold cavity of a mold device, filling an iron powder into said mold cavity of said mold device, punching said coil assembly and said iron powder to form a prototype, disengaging said prototype from said mold cavity of said mold device, annealing said prototype, lasering said lateral extension and said lateral segment of said coil, and electroplating an electroplating layer to said lateral extension and said lateral segment of said coil.

2. The inductor manufacturing method as claimed in claim 1, wherein said electroplating layer includes a copper layer.

3. The inductor manufacturing method as claimed in claim 1, wherein said electroplating layer includes a nickel layer.

4. The inductor manufacturing method as claimed in claim 1, wherein said electroplating layer includes a tin layer.

5. The inductor manufacturing method as claimed in claim 1, wherein said iron powder is selected from an outer diameter ranged from 0.1 to 200 micron.

6. The inductor manufacturing method as claimed in claim 1, wherein said coil assembly and said iron powder are subjected with a punching force ranged from 0.1-10 ton.

7. The inductor manufacturing method as claimed in claim 1, wherein said prototype is subjected with an annealing temperature ranged between 300-600° C. for one hour.

* * * * *